US007243389B2

(12) United States Patent
Phillipson et al.

(10) Patent No.: US 7,243,389 B2
(45) **Date of Patent: *Jul. 17, 2007**

(54) FLUID ENVIRONMENT CLEANER

(76) Inventors: Brian Phillipson, 555 Timber Ridge Dr., Longwood, FL (US) 32779; Kevin J. Phillipson, 555 Timber Ridge Dr., Longwood, FL (US) 32779; Pavel Sebor, 751 Cricklewood Ter., Heathrow, FL (US) 32746

( * ) Notice: Subject to any disclaimer, the term of this patent is extended or adjusted under 35 U.S.C. 154(b) by 0 days.

This patent is subject to a terminal disclaimer.

(21) Appl. No.: 10/996,137

(22) Filed: Nov. 23, 2004

(65) Prior Publication Data

US 2005/0155166 A1 Jul. 21, 2005

Related U.S. Application Data

(63) Continuation of application No. 10/390,577, filed on Mar. 17, 2003, now Pat. No. 6,820,297, which is a continuation of application No. 09/867,275, filed on May 29, 2001, now Pat. No. 6,560,808, which is a continuation of application No. 09/306,925, filed on May 7, 1999, now Pat. No. 6,237,175.

(60) Provisional application No. 60/085,102, filed on May 12, 1998.

(51) Int. Cl.
*E04H 4/16* (2006.01)

(52) U.S. Cl. ..... 15/1.7

(58) Field of Classification Search ..... 15/1.7
See application file for complete search history.

(56) References Cited

U.S. PATENT DOCUMENTS

| | | | | | |
|---|---|---|---|---|---|
| 3,803,658 | A | * | 4/1974 | Raubenheimer | 15/1.7 |
| 4,023,227 | A | * | 5/1977 | Chauvier | 15/1.7 |
| 4,095,378 | A | * | 6/1978 | Urakami | 451/88 |
| 4,133,068 | A | * | 1/1979 | Hofmann | 15/1.7 |
| 4,208,752 | A | * | 6/1980 | Hofmann | 15/1.7 |
| 4,434,519 | A | * | 3/1984 | Raubenheimer | 15/1.7 |
| 4,521,933 | A | * | 6/1985 | Raubenheimer | 15/1.7 |
| 4,536,908 | A | * | 8/1985 | Raubenheimer | 15/1.7 |
| 4,642,833 | A | * | 2/1987 | Stoltz et al. | 15/1.7 |
| 4,742,593 | A | * | 5/1988 | Kallenbach | 15/1.7 |
| 4,769,867 | A | * | 9/1988 | Stoltz | 15/1.7 |
| 4,807,318 | A | * | 2/1989 | Kallenbach | 15/1.7 |
| 4,817,225 | A | * | 4/1989 | Stoltz | 15/1.7 |
| 5,293,659 | A | * | 3/1994 | Rief et al. | 15/1.7 |
| 5,404,607 | A | * | 4/1995 | Sebor | 15/1.7 |
| 5,418,994 | A | * | 5/1995 | Rissik et al. | 15/1.7 |
| 5,469,596 | A | * | 11/1995 | Rief et al. | 15/1.7 |

* cited by examiner

*Primary Examiner*—Mark Spisich
(74) *Attorney, Agent, or Firm*—Greenberg Traurig, LLP

(57) ABSTRACT

A swimming pool cleaner is operable through a vibratory movement of its housing through a flow of water past a vibratory element carried within the housing. A friction support is carried by the housing and engages a surface to be cleaned. The friction support has a first end pivotally attached to the housing and a second free end in frictional contact with the surface to be cleaned. The friction support is further biased toward a first orientation and limited in its movement therefrom as the friction support is displaced during vibration of the housing and movement of the pool cleaner.

22 Claims, 11 Drawing Sheets

FLUID ENVIRONMENT CLEANER

CROSS-REFERENCE TO RELATED APPLICATIONS

This application is a continuation of U.S. application Ser. No. 10/390,577, filed Mar. 17, 2003, now U.S. Pat. No. 6,820,297 which is a continuation of U.S. application Ser. No. 09/867,275, filed May 29, 2001, now U.S. Pat. No. 6,560,808, which is a continuation of U.S. application Ser. No. 09/306,925, filed May 7, 1999 now U.S. Pat. No. 6,237,175 which claims the benefit of U.S. Provisional Application No. 60/085,102, filed May 12, 1998, commonly owed with the instant application.

BACKGROUND OF THE INVENTION

This invention relates generally to self propelled devices for cleaning submerged surfaces such as found in swimming pools. More particularly, it relates to friction feet which support swimming pool cleaners relative to and engagable with a surface to be cleaned.

Mechanical pool cleaners which utilize the flow of water drawn through the cleaner by means of a connecting flexible suction hose in communication with a filtration system pump are well known. Such pool cleaners are termed suction cleaners. Some suction cleaners include devices to establish reciprocating, impulsive, and vibratory forces useful for providing the propulsive force to move the cleaner in a random manner across the surface to be cleaned.

In U.S. Pat. No. 3,803,658 to Raubenheimer, an apparatus is disclosed which uses a repetitive variation in the flow of fluid through the apparatus to submit various components to variable loads and thereby impart stepwise movement to the apparatus across the surface to be cleaned.

A suction cleaner described in U.S. Pat. No. 4,023,227 to Chauvier uses the oscillatory movement of a flapper valve located in the operating head of the cleaner to impart impulsive forces to the apparatus for the purpose of moving the apparatus along the surface to be cleaned. U.S. Pat. Nos. 4,133,068 and 4,208,752 to Hofmann also use an oscillatable valve located in the head of the cleaner to provide impulsive forces to the apparatus for the purpose of moving the apparatus along the surface to be cleaned.

U.S. Pat. Nos. 4,682,833 and 4,742,593 to Stoltz and Kallenbach, respectively, disclose the use of an expansible tubular diaphragm to achieve a pulsating flow of fluid through the cleaner assembly and resultant forces suitable for the displacement of a pool cleaning apparatus over a surface to be cleaned.

Other means to provide impulsive, vibratory forces to a pool cleaner device are disclosed in U.S. Pat. No. 4,807,318 to Kallenbach, U.S. Pat. Nos. 4,769,867 and 4,817,225 to Stoltz and U.S. Pat. No. 5,404,607 to Sebor.

U.S. Pat. No 4,434,519 to Raubenheimer describes a suction cleaner having at least one friction support attached directly to the frame of the cleaner for engaging the submerged surface. The cleaner uses turbine means to impart reciprocating vibratory forces to the frame oblique to the submerged surface and alternately acting through the friction support in two opposed directions, the force in a first direction tending to lift the friction support from the surface and the force in the second direction tending to push the friction support back onto the surface, the resulting effect of said oblique forces and the bias caused by suction causing the apparatus to advance over the surface in a step by step manner. The friction support is a pivotally mounted foot projecting at an angle to the submerged surface and biased towards the vertical of said surface. Further improvements and a later embodiment of the aforementioned device were disclosed by Raubenheimer in U.S. Pat. No. 4,536,908.

U.S. Pat. No. 5,293,659 to Rief et al. discloses the use of a vibrator device and inclined bristle supports which work together to cause forward movement of the cleaner over the surface to be cleaned. Rief '659 discloses bristle supports inclined resilient supports. The term "resilient" is described as being the inherent characteristic of the support itself to bend. The bottom ends of the supports are offset from their corresponding top ends in a common direction.

SUMMARY OF THE INVENTION

In view of the foregoing background, it is therefore an object of the present invention to provide improved friction supports for incorporation into swimming pool devices which, in order to achieve forward motion, use the action of reciprocating vibratory forces and such friction supports in engagement with a submerged surface to be cleaned. In particular, it is an object of this invention to improve upon the stiff pivotally mounted friction supports known in the art by integrally forming the resilient biasing means with a stiff, support. This will reduce the number of components and simplify assembly and maintenance. A further object is to integrally form the pivot means or fulcrum with either the housing or the support itself. This will further reduce the number of components, simplify assembly and maintenance. It is yet another object to provide means which will enable oscillatory movement of a stiff or generally rigid support without the need for engagement of the support against a shaft or fulcrum. Yet another object is to use resilient membranes which are predisposed to deform in a desired manner to provide oscillatory movement of the free end of a support, regardless of whether or not the support is initially oriented at an angle to the surface to be cleaned. It is also contemplated that the system and method are useful in fluid environments other than swimming pools and spas. Further, the invention will be useful for incorporation with "pressure end" swimming pool cleaners which operate on the return flow of fluid from a pump, through a flexible hose connected to the cleaner and into the swimming pool.

According to the present invention, there is provided a device for cleaning surfaces submerged in a liquid. A swimming pool cleaner operable through a vibratory movement thereof is provided and comprises a housing, vibrating means carried by the housing for providing a vibratory movement thereto, a friction support carried by the housing at a first orientation thereto for operably engaging a surface to be cleaned, the friction support having a first end pivotally attached to the housing, and a second free end in frictional contact with the surface to be cleaned, and biasing means operable between the housing and the friction support for biasing the friction support toward the first orientation and limiting movement thereof, which movement displaces the free end and thus the support from the first orientation to a second orientation.

The cleaner is in communication with a suction pump and motor by means of a flexible elongated hose connected to a coupling located on top of a housing. The cleaner housing incorporates at least one suction chamber comprising an entrance end in proximity to the submerged surface to be cleaned and an exit end communicating with the coupling. A vibrator device is located within at least one suction chamber. At least one support is attached relative to the device for engaging the submerged surface to be cleaned.

The support may be partly or wholly manufactured from a rubber-like friction material. Its free end may integrally incorporate or be capable of receiving an attachment incorporating a protuberance, shape, dimension or surface characteristic which will provide a frictional grip against the surface to be cleaned.

During operation, an inertial mass forming part of the cleaning device, energized by a vibratory device into vibratory or to-and-fro motion, acts through the friction supports to generate reciprocating forces oblique to the surface to be cleaned and in at least two opposed directions in turn, the force in an upwards direction tending to lift the support from the surface and the force in a downwards direction tending to push the friction support back onto the surface, the resultant of the downward force and the downward bias caused by suction, causing the apparatus to advance over the surface in a step by step manner.

All of the supports disclosed have the following common characteristic: Their free ends are all capable of oscillatory movement between two positions; typically a few millimeters.

First embodiments of substantially rigid, stiff friction supports (i.e. supports which do not bend and straighten along their length) are pivotally mounted to the cleaner device at an angle to the surface to be cleaned, such that, upon application of a downward force, the support will oscillate about an axis generally lateral to the downward force, the improvement being that means to return the friction support to the first position upon removal of the downward force are integrally formed with the-friction support.

Second embodiments of friction supports are attached and oriented such that the point of contact by each support's free end against the surface to be cleaned is directly below the point of attachment of the support relative to the housing (i.e. the supports are not inclined), the shape of the support between the latter points designed such that, upon application of a downward force, at least a portion of the support will flex and thus produce a resultant force including a component capable of moving the cleaner device in a forward direction.

Yet other embodiments of friction supports have at least two points of attachment with respect to the housing such that lines drawn between the points of attachment of each support and the point of contact by each support's free end against the surface to be cleaned will not incline in a common direction.

BRIEF DESCRIPTION OF THE DRAWINGS

A preferred embodiment of the invention, as well as alternate embodiments are described by way of example with reference to the accompanying drawings in which.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
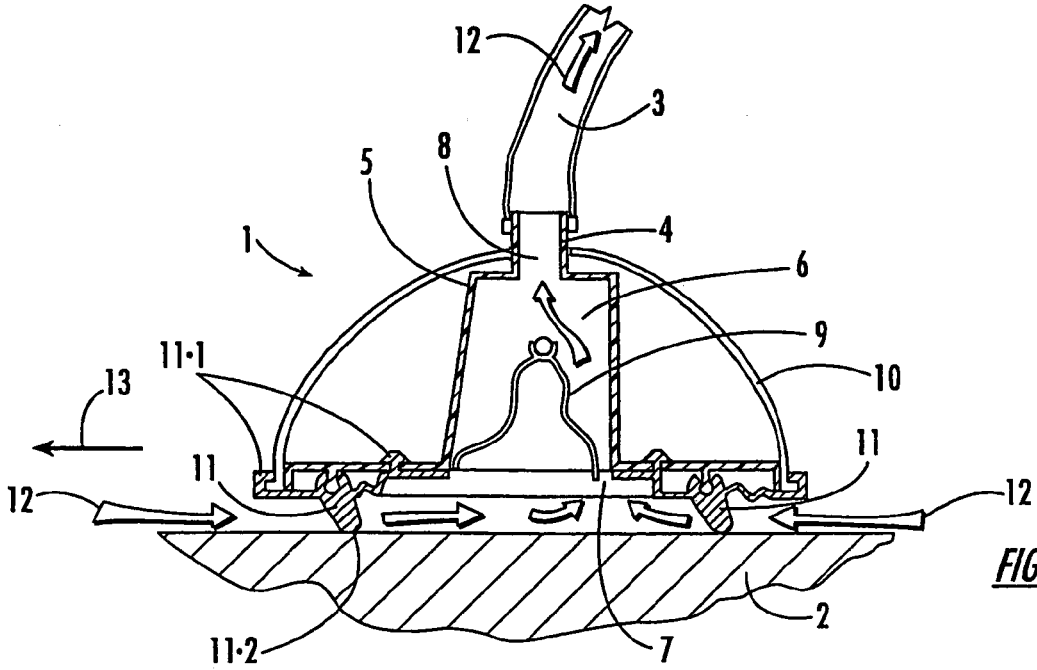
FIG. 1 is a cross-section view of a pool cleaner illustrating one embodiment of friction supports of the present invention.
Figure 2:
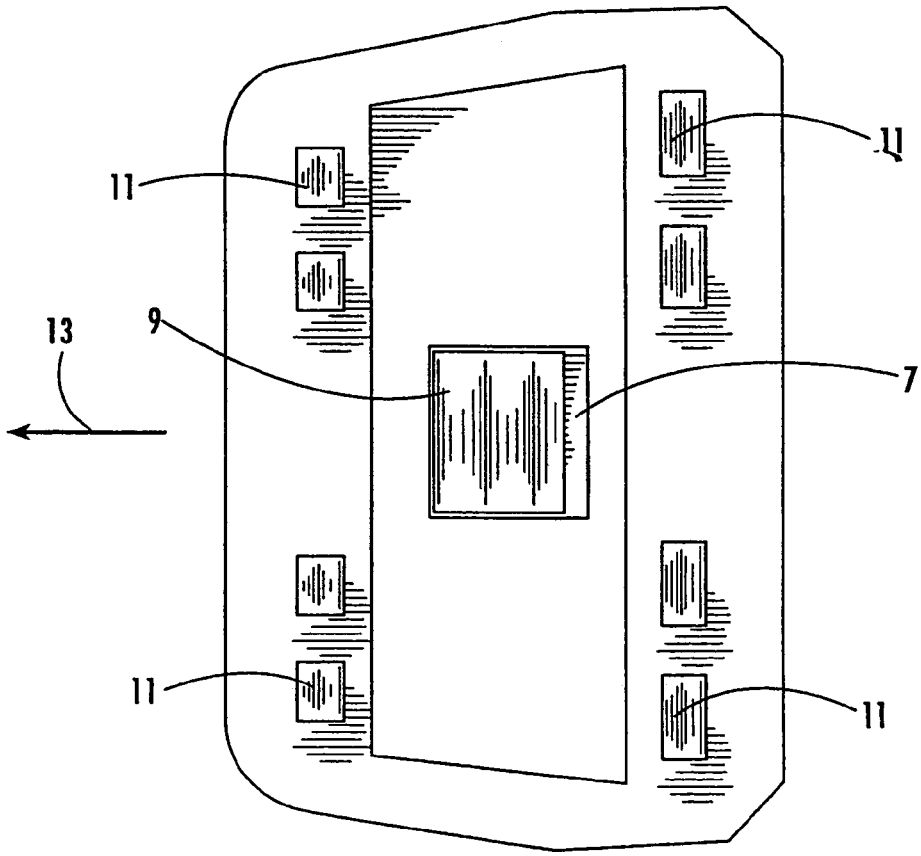
FIG. 2 is a bottom plan view of the pool cleaner of FIG. 1.

FIGS. 1 and 2 show a device 1 for cleaning a surface 2 submerged in a liquid. The cleaner 1 is in communication with a remote suction pump and motor by means of a flexible elongated hose 3 connected to a coupling 4 located on top of a housing 5. The cleaner housing 5 incorporates at least one suction chamber 6 comprising a fluid entrance end 7 in proximity to the submerged surface 2 to be cleaned and an exit end 8 communicating with the coupling 4. A vibrator device 9 such as a flapper valve, turbine with weight, turbine with eccentrics or other vibrator device as described in the prior art is located within at least one suction chamber 6. An outer housing 10 may be fitted to the main housing 5. At least one support 11 is attached relative to the device 1 for engaging the submerged surface 2 to be cleaned.

The free end 11.2 of the rigid support 11 must be able to move a distance of a few millimeters between a first and a second position, and then spring back to the first position.

Figure 3:
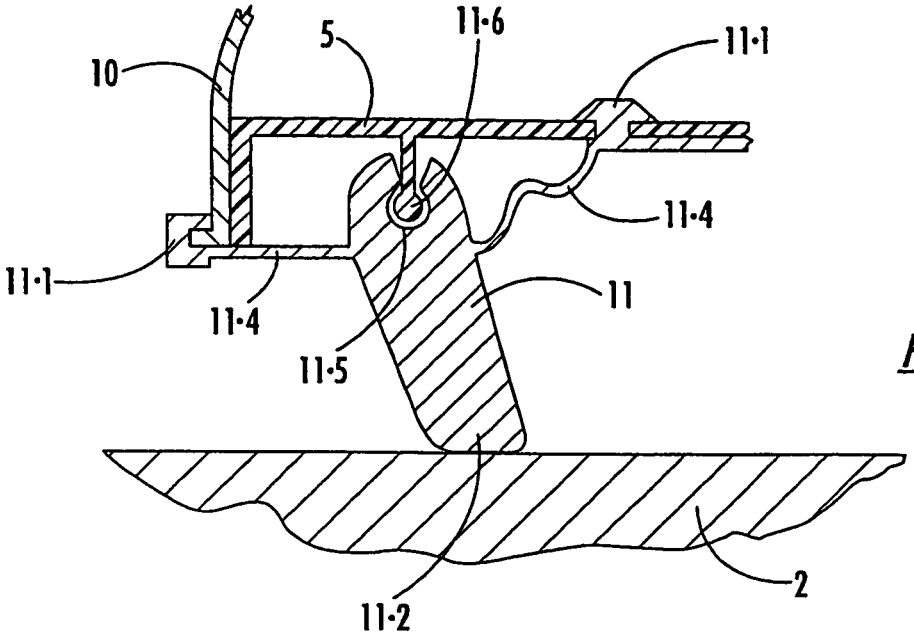
FIG. 3 is a partial enlarged, cross-section view of the friction support of FIG. 1.
Figure 4:
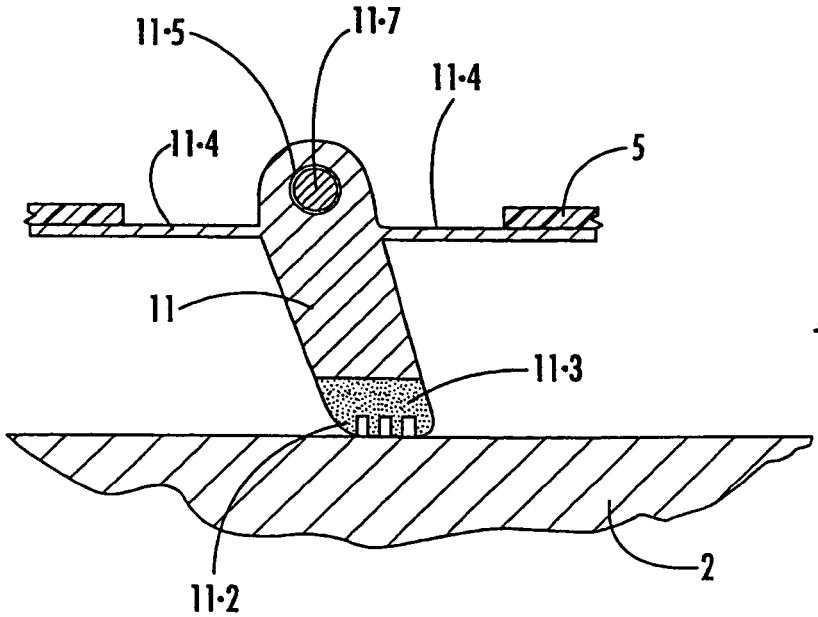
FIG. 4 is a partial cross-section view of a second embodiment of the friction support of the present invention.

In preferred embodiments illustrated in FIGS. 3 and 4, the support is pivotally mounted at an angle to the surface 2 to be cleaned. FIG. 4 depicts a support 11 with a bore 11.5 into which a shaft 11.7 is inserted. FIG. 3 depicts a pivot member or fulcrum 11.6 integrally formed with the main housing 5 and a support 11 with a bore or cup 11.5 adapted to engage with the pivot member 11.6. Rotation of the support 11 about a pivot axis enables oscillatory movement of the free end 11.2 of the support. The illustrated supports 11 may be partly or wholly manufactured from a rubber-like friction material and, in operation, are substantially rigid; i.e. do not bend and straighten along their length between the free end 11.2 and the opposing end proximate the pivot axis.

The preferred embodiments shown in FIGS. 3 and 4 are integrally formed with resilient biasing or spring means 11.4 to orient the rigid support 11 to a first position and to limit movement of the free end 11.2 of the support. This arrangement improves upon the prior art by eliminating the need for a separate orientation spring and stop. The embodiment in FIG. 3 further improves on the prior art because the pivot member 11.6 integrally formed with the main housing 5 eliminates the need for a separate shaft and means to position and attach such shaft to the housing 5.

Figure 5:
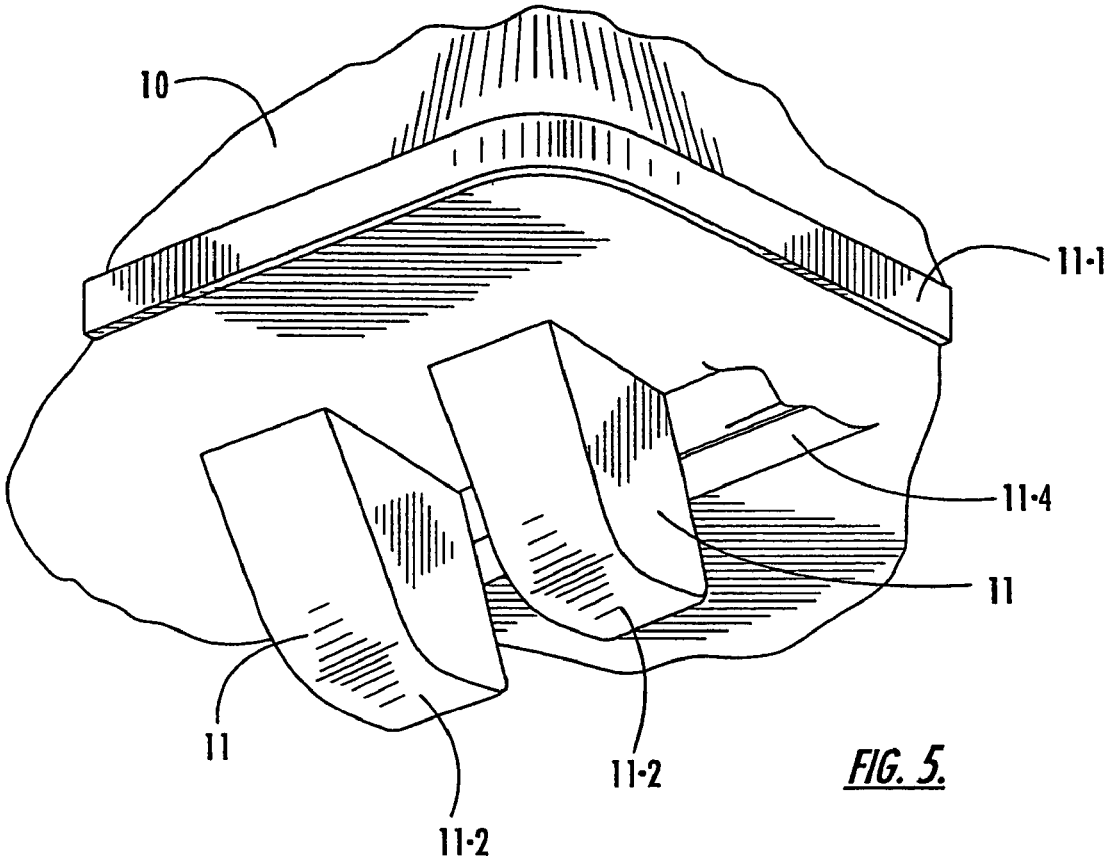
FIG. 5 is a partial perspective bottom view of the pool cleaner of FIG. 1.

As illustrated by FIGS. 1 and 3, to simplify assembly of the device 1 and further reduce the number of separate parts required, support attachment means 11.1 may also be integrally formed with the support 11, or both the support 11 and resilient biasing means 11.4, to enable removable attachment of the support 11, the main housing 5 and the outer housing 10. Additionally as illustrated by FIGS. 1, 2 and 5, the integrally formed supports, resilient biasing means 11.4 and attachment means form a membrane-like barrier between dirt-laden fluid flow 12 towards the chamber entrance end 7 and the end of the support proximate and including the pivot bore or cup 11.5. This reduces the detrimental effect of dirt and grit upon the pivoting action of the supports 11. A modified bore or cup 1.5 for engagement with a pivot member 11.6 is preferred over a completely round bore 11.5 because the modified bore or cup will be less prone to entrap dirt and thus hinder or prevent the support 11 from being able to pivot.

As depicted in FIG. 4, the free end 11.2 of a support 11 may integrally incorporate or be capable of receiving an attachment 11.3 incorporating a protuberance, shape, dimension or surface characteristic which will provide a frictional grip against the surface 2 to be cleaned.

Figures 6A, 6B, 6C, 6D:
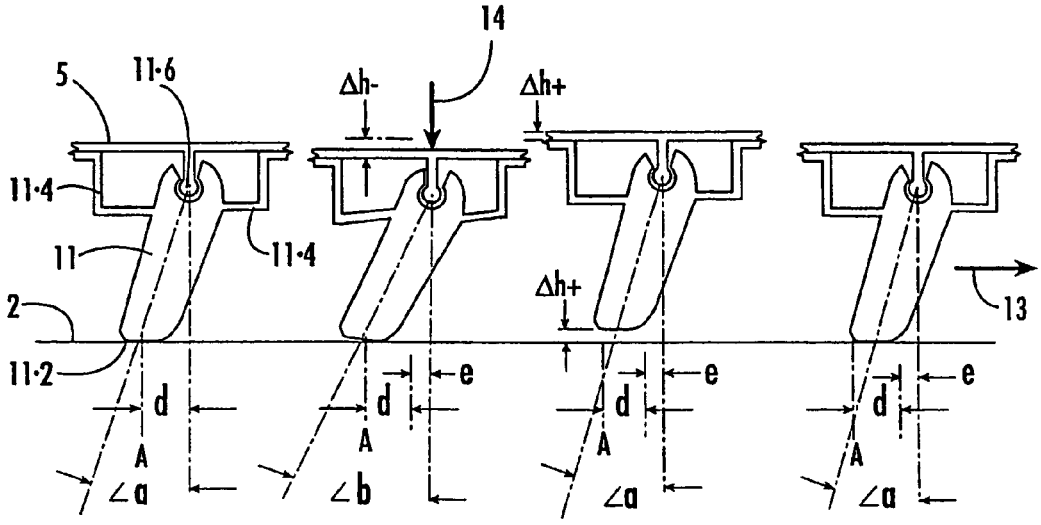
FIGS. 6A–6D are partial cross-section views of the friction support of FIG. 1, illustrating operation thereof.

FIGS. 6A, 6B, 6C and 6D illustrate the operation of a pivotable rigid support 11. In operation, the cleaning device 1 is energized by a vibratory device 9 into vibratory or to-and-fro motion. The vibrating mass acts through the rigid friction supports 11 to generate reciprocating forces oblique to the surface 2 to be cleaned and in at least two opposed directions in turn. FIG. 6A shows a support in a neutral position. This state will exist prior to the application of any force other than that applied by an inertial mass forming part of the cleaning device 1; i.e. prior to activating of the vibratory device by action of the fluid flow through the suction chamber 6. A similar state will momentarily exist as the forces applied to the support 11 reciprocate between the downward and upward directions. In FIG. 6B, a force in a downwards direction 14 pushes the friction support 11 against the surface 2. While the frictional grip of the free end 11.2 against the surface 2 maintains the position of the free end 11.2 relative to an imaginary point on the surface 2 marked "A", the downwards force 14 causes the support to pivot which, in turn, causes the resilient biasing means 11.4 to deform and the housing to which the support 11 is attached to move a distance "e" in the direction of arrow 13. Upon reciprocation of the force in the opposite, (upwards) direction, the support 11 will momentarily be lifted from the surface as shown in FIG. 6C. As this occurs, the resilient biasing means 11.4 will return the support to the neutral position. FIG. 6D shows, at a moment immediately prior to the re-commencement of the cycle just described, the support 11 re-engaged with the surface and the new position of the free end 11.2 of the support 11 relative to point "A" against the surface 2. The free end 11.2 is shown to have moved a distance "e" in the direction of arrow 13. This illustrates how the cleaner device 1 will, in response to vibration, advance over the surface 2 in a step by step manner.

Figure 7A:
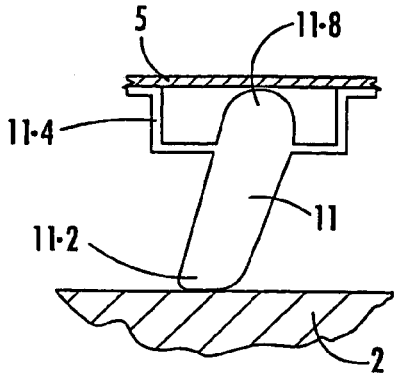
FIGS. 7A and 7B are partial cross-section views of a third embodiment of a friction support illustrating operation thereof.
Figure 7B:
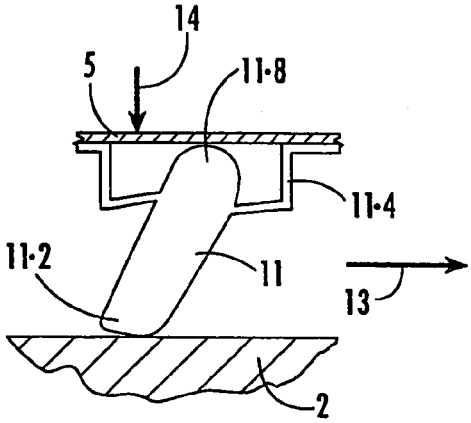

FIG. 7A illustrates a rigid support 11 oriented at an angle to the surface 2 to be cleaned. An upper end 11.8 of the support 11 opposing the surface 2 contacting free end 11.2, is shaped and resiliently positioned in slidable engagement with the housing 5 such that, upon application of downward force 14, the upper end 11.8 will pivot against the housing 5 as shown in FIG. 7B. This embodiment eliminates the need for a pivot member 11.6.

Figure 8A:
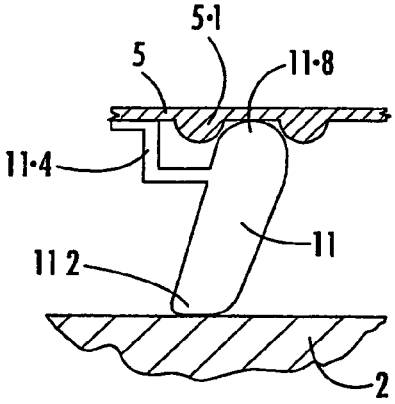
FIGS. 8A and 8B are partial cross-section views of a fourth embodiment of a friction support illustrating operation thereof.
Figure 8B:
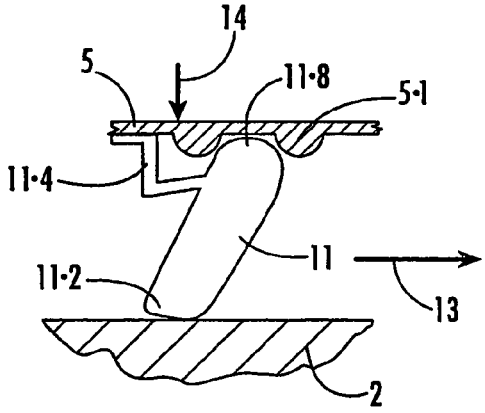

FIGS. 8A and 8B depict an improvement in which the housing 5 is shaped 5.1 to form a groove to receive and position the upper end 11.8 of a rigid support 11.

Figure 9A:
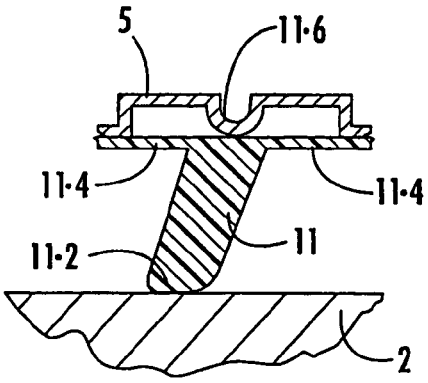
FIGS. 9A and 9B are partial cross-section views of a fifth embodiment of a friction support illustrating operation thereof.
Figure 9B:
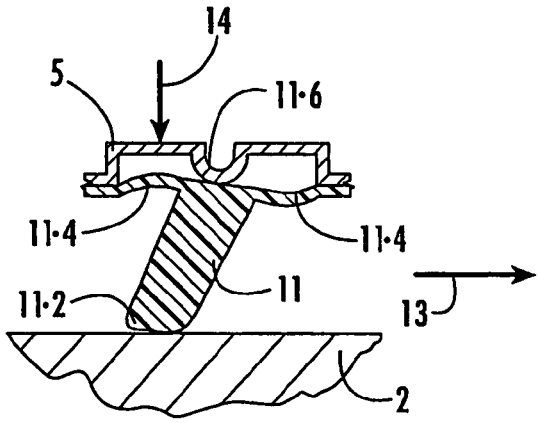

FIGS. 9A and 9B depicts an alternative embodiment where the housing 5 incorporates a pivot member or fulcrum 11.6 for engagement with an upper end 11.8 of a rigid support 11.

Figure 10A:
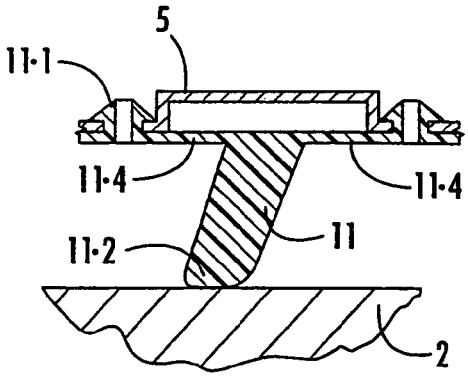
FIGS. 10A and 10B are partial cross-section views of a sixth embodiment of a friction support illustrating operation thereof.
Figure 10B:
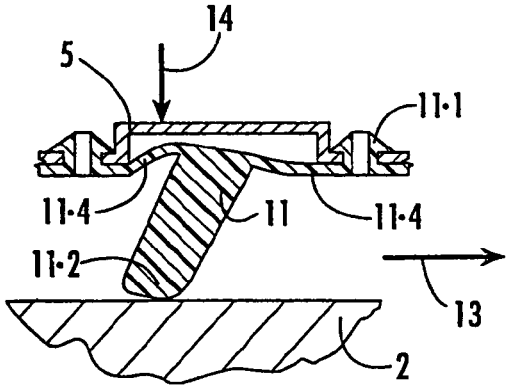

FIGS. 10A and 10B show a rigid support 11 attached to and spaced from a housing 5 by resilient biasing means 11.4 and attachment means 11.1 such that, upon application and removal of a downward force 14, at least a portion of the resilient biasing means 11.4 will deform thus enabling the rigid support to oscillate and the cleaner 1 to advance across the surface to be cleaned. The degree of oscillation of the rigid support 11 may be controlled by the degree of flexibility, elasticity, length, thickness and shape of attached resilient biasing means 11.4.

Figure 11:
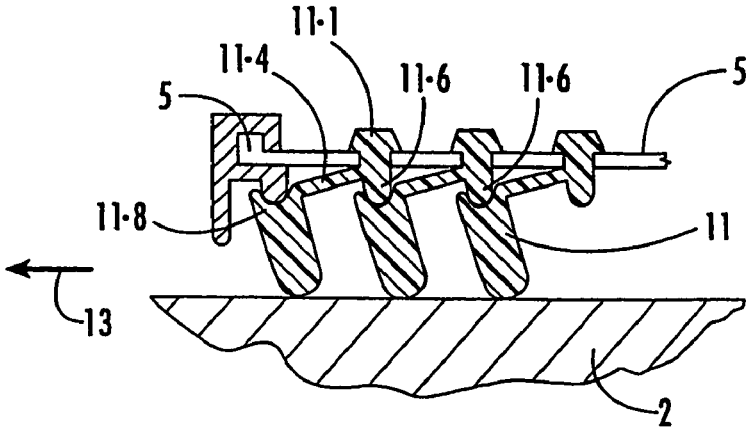
FIG. 11 is a partial cross-section view of a seventh embodiment of the present invention.
Figure 12A:
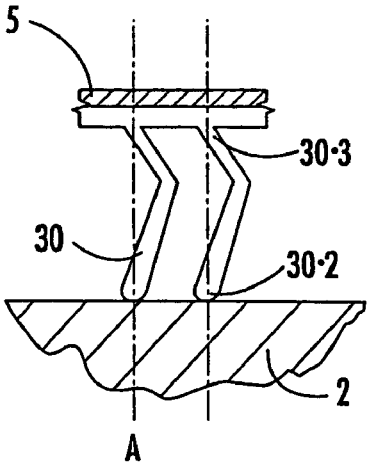
FIGS. 12A and 12B are partial cross-section views of an eighth embodiment of a friction support illustrating operation thereof.
Figure 12B:
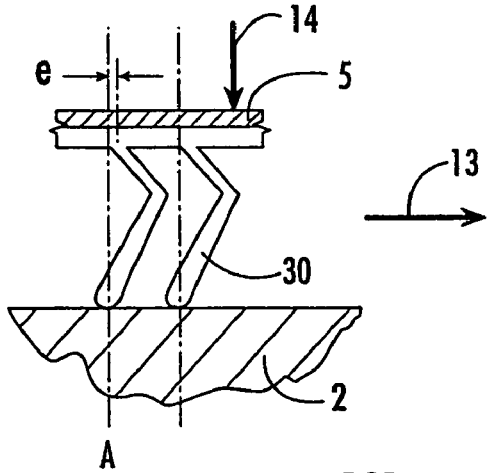
Figure 13A:
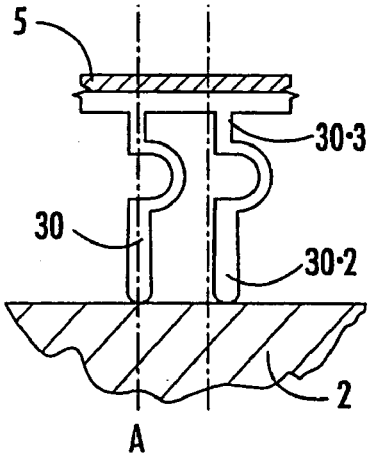
FIGS. 13A and 13B are partial cross-section views of a ninth embodiment of a friction support illustrating operation thereof.
Figure 13B:
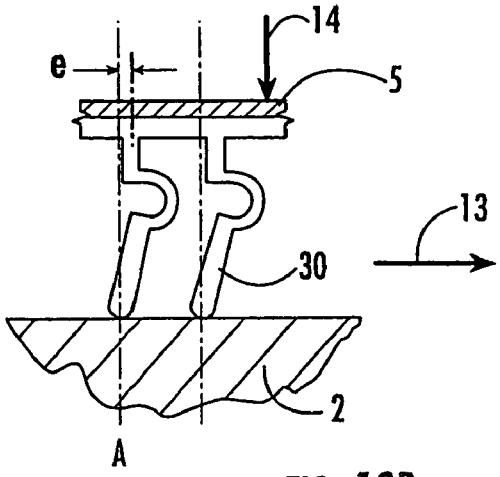

FIG. 11 provides an example of a rigid support 11 mounted to the housing 5 of a cleaning device 1 and oriented at an inclination to the surface 2 to be cleaned by resilient biasing means 11.4. The support 11 includes an upper end 11.8 shaped for pivotal engagement with a pivot member 11.6 integrally formed with an adjacent support member 11.

As stated, in order to achieve forward movement in response to vibration, the free end of each support must be capable of movement of up to a few millimeters. The rigid (i.e. supports which do not bend and straighten along their length), spring loaded supports 11 like those illustrated in FIGS. 1 through 11 achieve this by being oriented at an inclination relative to the surface 2 to be cleaned and by attachment to the cleaning device I in a manner which will enable the supports 11 to oscillate about an axis generally lateral to a downward force 14. As disclosed below, alternative support configurations can achieve the required movement of their free ends by other means.

FIGS. 12A, 12B, 13A, 13B provide examples of resilient friction supports 30, all of which are attached and oriented such that the point of contact by each support's free end 30.2 against the surface 2 to be cleaned is directly below the point of attachment 30.3 of the support 30 relative to the housing 5 (i.e. in this context the supports are not inclined, at least not in a specific common direction). The shape or geometry of the support between the latter points is designed such that, upon intermittent application of a downward force 14, at least a portion of the support will deform and thus produce a resultant force including a component capable of moving the cleaner device 1 in step by step increments in a forward direction 13, such increments indicated in the FIGS. by the dimension "e" in relation to a point "A" against the surface 2.

Figure 14A:
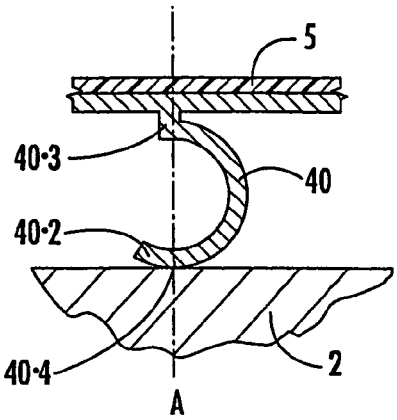
FIGS. 14A and 14B are partial cross-section views of a tenth embodiment of a friction support illustrating operation thereof.
Figure 14B:
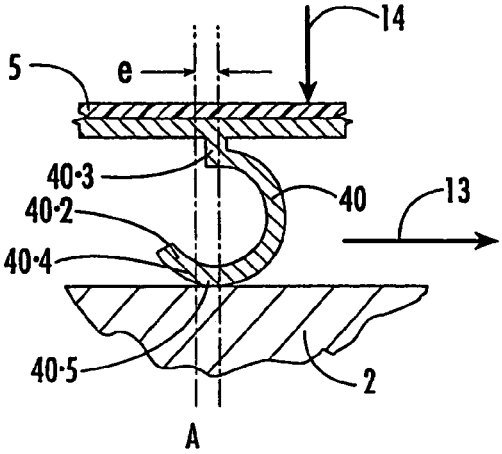
Figure 15A:
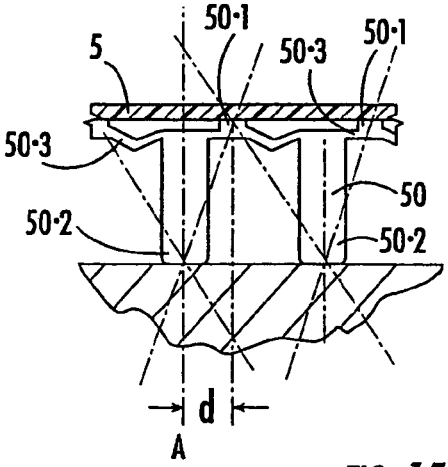
FIGS. 15A and 15B are partial cross-section views of an eleventh embodiment of a friction support illustrating operation thereof.
Figure 15B:
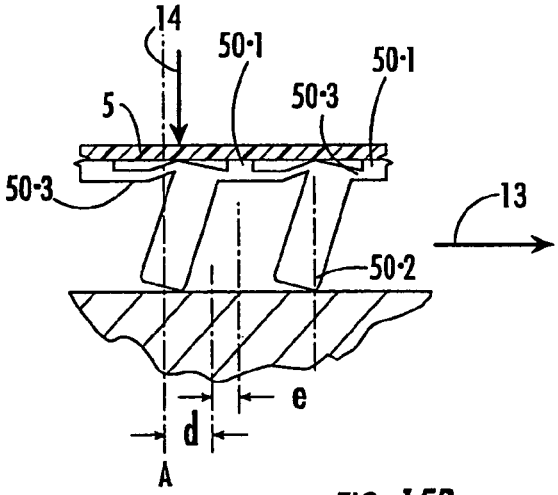
Figure 16A:
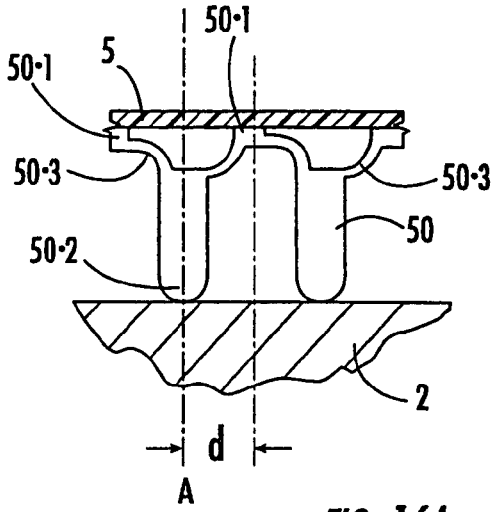
FIGS. 16A and 16B are partial cross-section views of a twelfth embodiment of a friction support illustrating operation thereof.
Figure 16B:
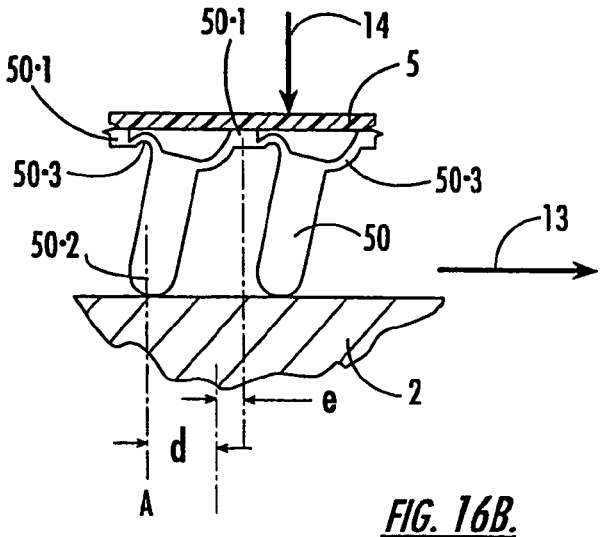
Figure 17A:
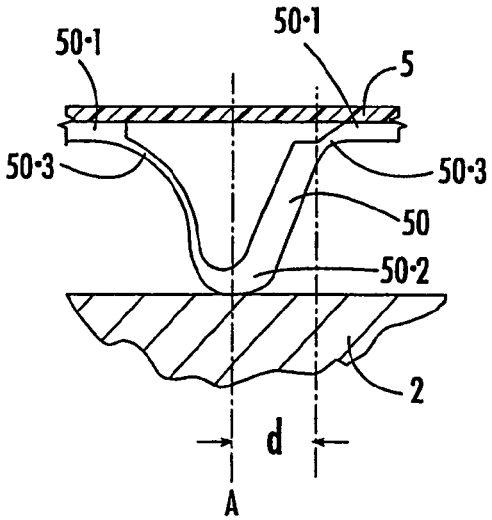
FIGS. 17A and 17B are partial cross-section views of a thirteenth embodiment of a friction support illustrating operation thereof.
Figure 17B:
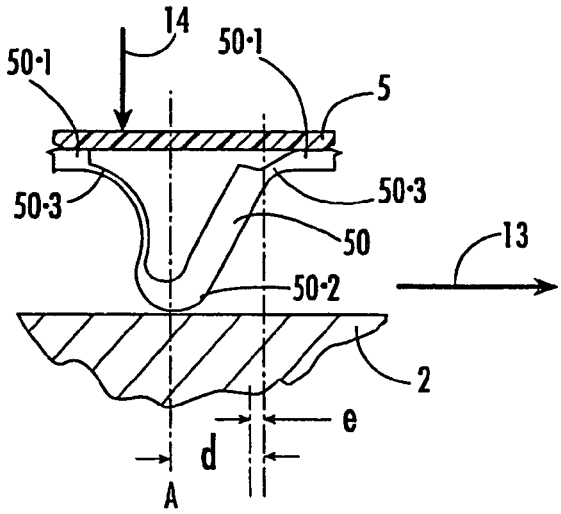
Figure 18:
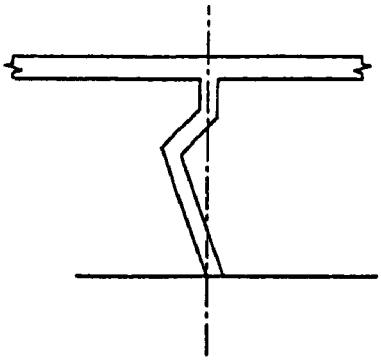
FIGS. 18–29 are partial cross-section views of yet other embodiments of a friction supports of the present invention.
Figure 19:
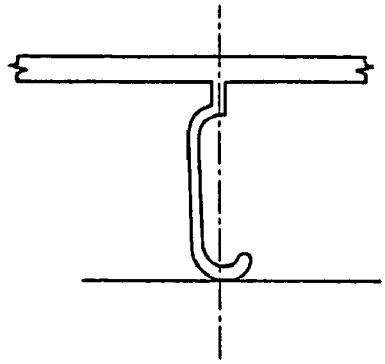
Figure 20:
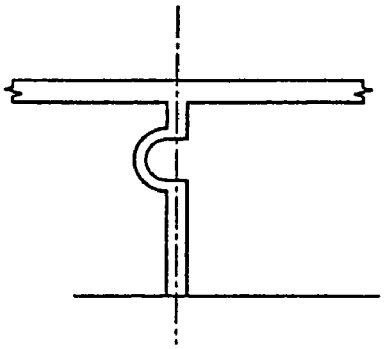
Figure 21:
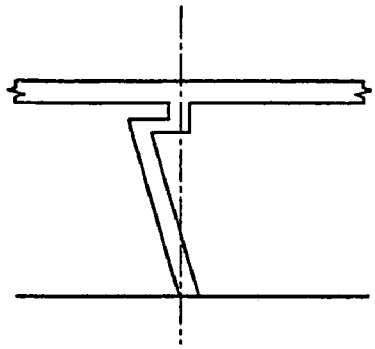
Figure 22:
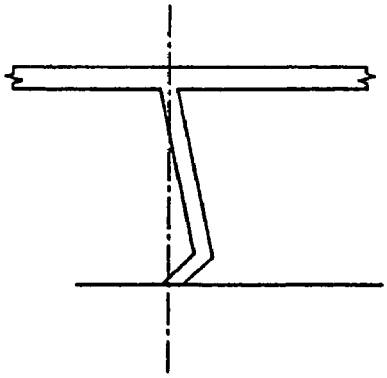
Figure 23:
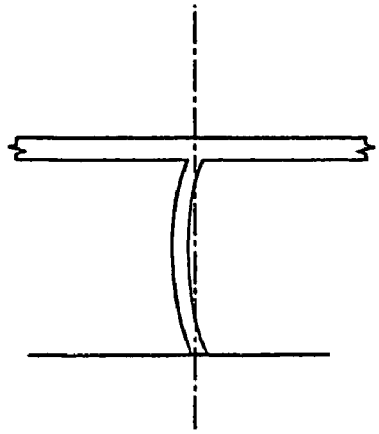
Figure 24:
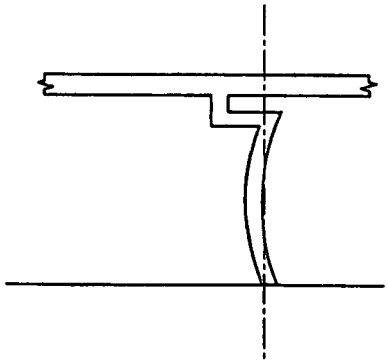
Figure 25:
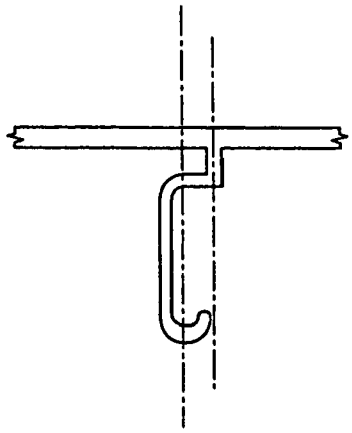
Figure 26:
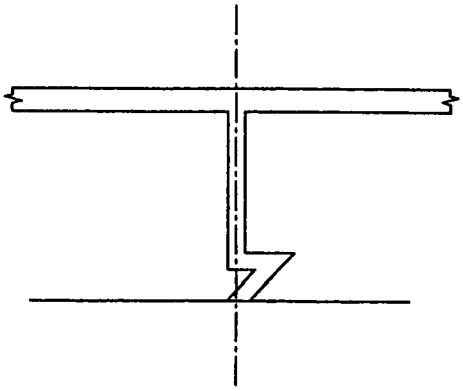
Figure 27:
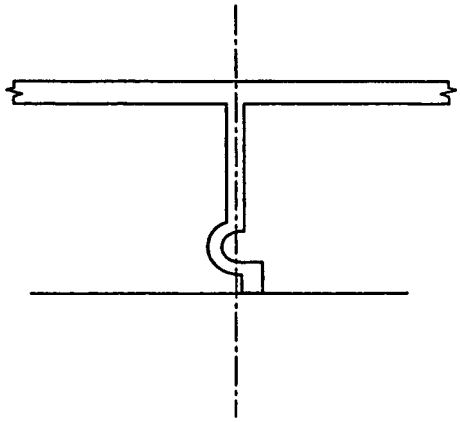
Figure 28:
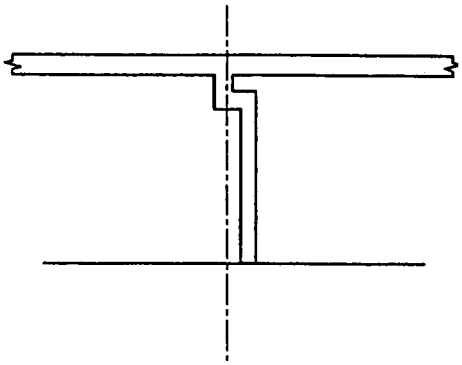
Figure 29:
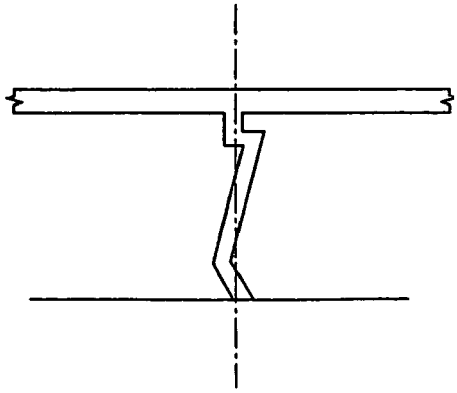

FIGS. 14A and 14B show a resilient support 40, a least a portion of which is circular in cross-section and attached such that the point of contact "A" against the surface 2 to be cleaned is directly below the point of attachment 40.3 of the support 40 relative to the housing 5 (i.e. the support is not inclined). The free end 40.2 of the support 40 need not be in contact with the surface 2. Upon intermittent application of a downward force 14, at least a portion of the support will deform and the portion of support 40.4 initially in contact with the surface 2 at point A will move in a direction which may be out of contact with the surface 2. The new point of contact of the support 40.5 with the surface 2 will remain substantially below the point of attachment 40.3 relative to the housing 5. The cleaner device I will thus move in step by step increments in a forward direction 13, such increments indicated in the FIGS. by the dimension "e" in relation to a point "A" against the surface 2. Along the portions of the support 40.4, 40.5 which make contact with the surface 2, friction grip enhancing treads or other means may be attached to or be integrated into the support 40.

FIGS. 15A, 15B, 16A, 16B, 17A and 17B illustrate supports 50 which are spaced from the housing 5 and have at least two points of attachment 50.1 with respect to the housing 5 such that lines drawn between the points of attachment 50.1 of each support 50 and the point of contact by each support's free end 50.2 against the surface to be cleaned will not incline in a common direction. Upon intermittent application of a downward force 14, flexible elements 50.3, predisposed to deform in a particular manner, will deform in such manner and thereby cause movement of the cleaner device I in step by step increments in a forward direction 13, such increments indicated in the FIGS. by the dimension "e" in relation to a point "A" against the surface 2.

FIGS. 18–29 illustrate elevation views of alternate embodiments of friction supports.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

The invention claimed is:

1. A cleaner for a fluid environment having a surface to be cleaned, the cleaner comprising:

a housing;

a friction support having a first end coupled to the housing and a second free end for frictional contact with the surface to be cleaned, the friction support pivotally mounted to the housing at an angle to the surface to be cleaned, such that, upon application of a downward force, the friction support will oscillate between a first orientation and a second orientation about an axis generally lateral to the downward force; and a pair of elongated biasing members coupled between the friction support and the housing, each elongated biasing member including a first end integrally formed with the friction support and a second end coupled to the housing, the pair of elongated biasing members being located on opposite sides of the friction support with respect to the first end of the friction support, the pair of elongated biasing members acting to return the friction support from the second orientation to the first orientation upon removal of the downward force.

2. The cleaner of claim 1, and further comprising a vibratory device that vibrates the housing.

3. The cleaner of claim 1, wherein the first end of the friction support includes a bore that receives a pivot member.

4. The cleaner of claim 3, wherein the housing includes a pivot member that engages the bore to rotate the friction support between the first orientation and the second orientation.

5. The cleaner of claim 1, wherein the friction support is at least partially manufactured from a rubber-like friction material.

6. The cleaner of claim 1, wherein the second free end includes at least one of a protuberance, a shape, a dimension, and a surface characteristic which provides a frictional grip against the surface to be cleaned.

7. A cleaner for a fluid environment having a surface to be cleaned, the cleaner comprising:

a housing;

a friction support having a first end coupled to the housing and a second free end for frictional contact with the surface to be cleaned, the friction support being oriented such that a point of contact by the second free end against the surface to be cleaned is substantially below a point of attachment of the friction support during at least a portion of the frictional contact with the surface to be cleaned; and a pair of elongated biasing members coupled between the friction support and the housing, each elongated biasing member including a first end integrally formed with the friction support and a second end coupled to the housing, the pair of elongated biasing members being located on opposite sides of the friction support with respect to the first end of the friction support, the pair of elongated biasing members flexing upon application of a downward force and producing a resultant force including a component capable of moving the cleaner in a forward direction.

8. The cleaner of claim 7, and further comprising a vibrating device that vibrates the housing.

9. The cleaner of claim 7, wherein the biasing members deform the friction support from a first orientation to a second orientation upon application of the downward force to move the housing in step by step increments in the forward direction.

10. The cleaner of claim 9, wherein the point of contact of the second free end with the surface to be cleaned is substantially below the point of attachment of the friction support in the first orientation.

11. The cleaner of claim 9, wherein the point of contact of the second free end with the surface to be cleaned is substantially below the point of attachment of the friction support in the second orientation.

12. The cleaner of claim 7, wherein the friction support is at least partially manufactured from a rubber-like friction material.

13. The cleaner of claim 7, wherein the second free end includes at least one of a protuberance, a shape, a dimension, and a surface characteristic which provides a frictional grip against the surface to be cleaned.

14. A cleaner for a fluid environment having a surface to be cleaned, the cleaner comprising:

a housing;

a friction support having a first end coupled to the housing and a second free end for frictional contact with a surface to be cleaned; and a pair of elongated biasing members coupled to the friction support and operable to deform the friction support from a first orientation to a second orientation, each elongated biasing member including a first end integrally formed with the friction support and a second end coupled to the housing the pair of elongated biasing members being located on opposite sides of the friction support with respect to the first end of the friction support, such that lines drawn between the second end of each of the pair of biasing members and a point of contact of the free end of the friction support against the surface to be cleaned do not incline in a common direction.

15. The cleaner of claim 14, and further comprising a vibratory device that vibrates the housing.

16. The cleaner of claim 14, wherein the point of contact of the free end with the surface to be cleaned is substantially below the point of attachment of the friction support in the first orientation.

17. The cleaner of claim 14, wherein the point of contact of the free end with the surface to be cleaned is substantially below the point of attachment of the friction support in the second orientation.

18. The cleaner of claim 14, wherein the first end of the friction support includes a bore that receives a pivot member.

19. The cleaner of claim 18, wherein the housing includes a pivot member that engages the bore to rotate the friction support between the first orientation and the second orientation.

20. The cleaner of claim 14, wherein the friction support is at least partially manufactured from a rubber-like friction material.

21. The cleaner of claim 14, wherein the free end includes at least one of a protuberance, a shape, a dimension, and a surface characteristic which provides a frictional grip against the surface to be cleaned.

22. A cleaner for a fluid environment having a surface to be cleaned, the cleaner comprising:

a housing;

a vibratory device that vibrates the housing;

a friction support having a first end at least partially coupled to the housing and a second free end for frictional contact with the surface to be cleaned; and a pair of elongated biasing members coupled between the housing and the friction support, each elongated biasing member including a first end integrally formed with the friction support and a second end coupled to the housing, the pair of elongated biasing members being located on opposite sides of the friction support with respect to the first end of the friction support, movement displacing the friction support between a first orientation and a second orientation, an elastic deforming of the elongated biasing members producing a resultant force to move the swimming pool cleaner in step by step increments in a forward direction.

* * * * *